US006217320B1

(12) United States Patent
Eaves

(10) Patent No.: US 6,217,320 B1
(45) Date of Patent: Apr. 17, 2001

(54) SPACE HEATING APPLIANCES

(75) Inventor: Robert Nicholas Eaves, West Midlands (GB)

(73) Assignee: Ambi-Rad Limited

( * ) Notice: Subject to any disclaimer, the term of this patent is extended or adjusted under 35 U.S.C. 154(b) by 0 days.

(21) Appl. No.: 09/530,843

(22) PCT Filed: Nov. 3, 1998

(86) PCT No.: PCT/GB98/03273

§ 371 Date: Jun. 22, 2000

§ 102(e) Date: Jun. 22, 2000

(87) PCT Pub. No.: WO99/24757

PCT Pub. Date: May 20, 1999

(30) Foreign Application Priority Data

Oct. 6, 1997 (GB) ..... 9723394

(51) Int. Cl.[7] ..... F27B 5/14

(52) U.S. Cl. ..... 432/209; 432/175; 432/222; 126/91 A

(58) Field of Search ..... 432/31, 38, 49, 432/175, 196, 209, 222; 126/91 A

(56) References Cited

U.S. PATENT DOCUMENTS

| | | | | |
|---|---|---|---|---|
| 3,822,690 | * | 7/1974 | Kofink | 126/110 B |
| 4,373,702 | * | 2/1983 | Jayaraman et al. | 432/175 |
| 4,878,480 | * | 11/1989 | Watson et al. | 432/209 |
| 5,000,158 | * | 3/1991 | Watson et al. | 432/209 |
| 5,628,303 | * | 5/1997 | Ahmady et al. | 126/91 A |
| 6,029,647 | * | 2/2000 | Pisano et al. | 432/209 |

* cited by examiner

*Primary Examiner*—Gregory Wilson
(74) *Attorney, Agent, or Firm*—Barnes & Thornburg

(57) ABSTRACT

Radiant tube space heating appliance (FIG. 1) has radiation ducting 10 with one or more inline burners 16 in a branch or branches 12 upstream of common tailpipe 20. An exhuast fan 22 in the tailpipe draws heated gases thought the ducting. A power operated control damper 28 in the tailpipe is actuated in response to sensing of the gas temperature in the tailpipe to reduce the induced flow therein when the temperature is below a certain level to counteract the increased volume throughput of the adjacent fan at lower temperature so that performance burners, e.g. on start up, is not adversely affected.

11 Claims, 2 Drawing Sheets

SPACE HEATING APPLIANCES

CROSS-REFERENCES TO RELATED APPLICATIONS

This application is a U.S. national application of international application serial No. PCT/GB98/03273 filed Nov. 3, 1998, which claims priority to United Kingdom serial No. 9723394.4 filed Nov. 6, 1997.

BACKGROUND AND SUMMARY OF THE INVENTION

This invention relates to radiant tube space heating appliances of the kind comprising branched or other radiation ducting, commonly suspended overhead in the space to be heated, an exhaust fan or other pump in a tailpipe of the ducting for drawing a flow of gases there through in use, and a series of inline fluid fuelled burner assemblies, typically gas fired and automatically controlled, upstream of the tailpipe for generating heat carried by said flow. Radiant heat is emitted from the ducting surfaces and this is commonly directed and concentrated, e.g. in a downward direction, by one or more reflectors mounted above or to the side of the ducting. Said appliances are hereinafter referred to as "continuous radiant tube heating appliances".

An example of one known construction of continuous radiant tube heating appliance is described in our GB 2,274,703-A and EP 0606782-A.

The object of the invention is to provide a continuous radiant tube heating appliance giving high performance with safety, reliability, and economy of operation.

According to the invention there is provided a continuous radiant tube heating appliance as hereinbefore defined including a control damper in the tailpipe selectively operable to throttle the flow of gases induced by the fan or other pump, a power actuator for adjusting the damper, and automatic control means including a temperature sensor responsive to the temperature of gases passing along the tailpipe in use and controlling operation of the actuator so as to reduce the induced flow when said temperature is below a predetermined level as on start-up of the appliance from cold.

Typically the appliance will comprise a single branch; or two or more ducting branches acting in parallel and with separate input ends through which individual flows of air are drawn during operation, each branch having a burner assembly or series of burner assemblies spaced along its length and all the branches being connected to a common tallpipe and exhaust fan associated with said control means.

A pre-set balancing damper may be included at the downstream end of each said branch upstream of the tailpipe.

Preferably the control damper and automatic control means are constructed as a unit to include a section of the tailpipe with the temperature sensor therein in close proximity to the damper providing simple installation by coupling into the other parts of the tailpipe and with an electrically powered actuator merely requiring connection to a power supply.

BRIEF DESCRIPTION OF THE DRAWINGS

An example of the invention is now more particularly described with reference to the accompanying drawings wherein.

DETAILED DESCRIPTION OF THE DRAWINGS

Figure 1:
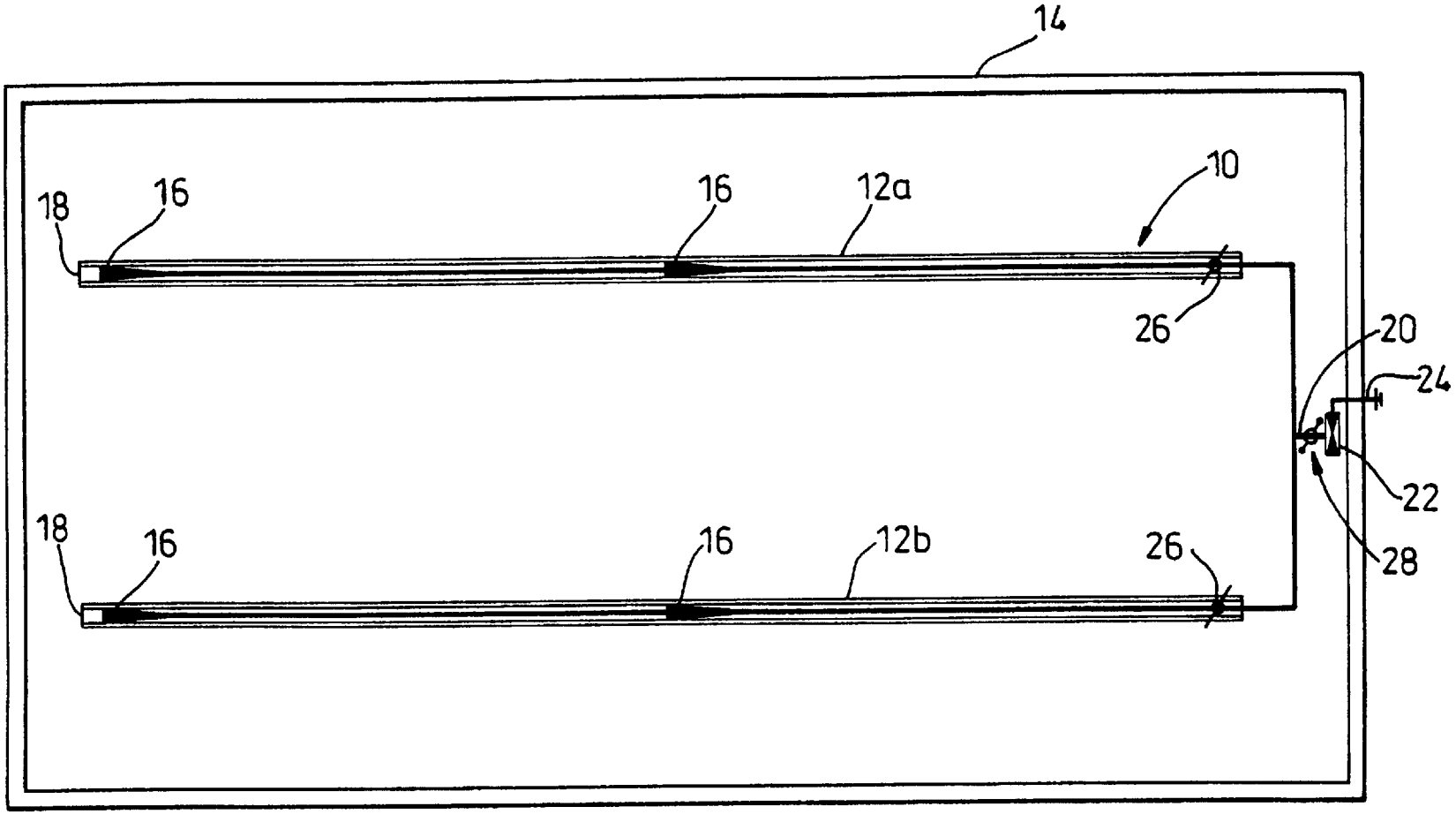
FIG. 1 is a diagrammatic plan view of an installation of a continuous radiant tube heating appliance.

The installation of the appliance shown in FIG. 1 comprises overhead suspended ducting 10 having two spaced parallel branches 12*a*, 12*b* for distribution of heat over the area of workspace or the like defined by walls 14.

Each of the branches 12 is provided with two high thermal input (e.g. 46 kW) gas fuel burner assemblies 16 of known construction.

An upstream burner in each branch is adjacent to its input end 18, said ends opening separately to atmosphere; and the second burner 16 in each branch is approximately halfway along its length.

The burners of this example use proportional control (zero governor) so that their heat input to ducting 10 increases in direct proportion to the induced draught along the respective branch.

The downstream ends of branches 12 are connected in T formation to a common tailpipe 20 of ducting 10 having a centrifugal exhaust fan 22 at its downstream end vented to a flue 24 discharging externally of the building.

To "tune" the appliance on installation, e.g. to balance out differences in flow otherwise present in branches 12, each branch has a preset balancing damper 26 at its downstream end. These dampers are used for setting up only and will not normally be adjusted subsequently.

The fan capacity is selected to provide optimum performance at normal operating temperatures in conjunction with the layout of the installation and its correct setting up and adjustment. However, the performance, i.e. throughput, of fan 22 increases at lower flow temperatures (due to the physical properties of fans) so that excessive flow is induced when handling cold air as on start-up of the appliance. As the burners 16 are self-proportioning they attempt to provide higher thermal input in response to the higher flow rate and this can give rise to problems in initial ignition and flame stabilisation during start-up and warming up.

With the relatively low thermal input burners (typically 30 kW) used in known continuous radiant tube heating appliances the above problem is mitigated to some extent by the use of a long tailpipe, for example in the installation layout shown in FIG. 1 a conventional installation might have a tailpipe extending back from the T connection the full length of the workspace between the branches 12 with the exhaust fan positioned on the opposite wall to its position in FIG. 1, this long tailpipe providing a balancing effect by cooling the exhaust gases to a low temperature before they reach the fan.

With an operating temperature of 120° C. in the tailpipe, as might be the typical case with the known lower thermal input burners referred to above and a long tailpipe the depression effected by the fan at optimum heat input taken as 100% would be around 6.2 mbar. On cold start-up, due to the cold flow operated on by the fan, said depression would probably be increased to around 7.5 mbar representing excessive heat input from the burner of around 109.6%.

Increasing the operating temperature by use of high thermal input burners, to say, 200° C. in a short tailpipe and with the fan operating at optimum of 100% heat input at that operating temperature, and set up to provide the same depression of 6.2 mbar, will result in a much more disproportionate increase when the fan is handling cold air, in the latter condition the depression will have risen to around 10.0 mbar giving a theoretical excessive heat input of 126.5% which would probably make ignition and warming up impossible or, at best, unstable and unreliable.

Figure 2:
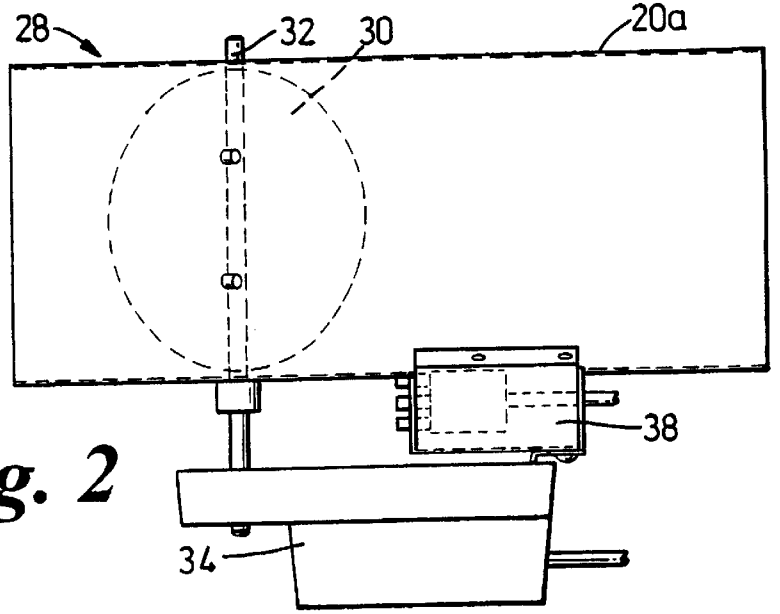
FIG. 2 is a detailed plan view of a control damper and actuator unit of the appliance.
Figure 3:
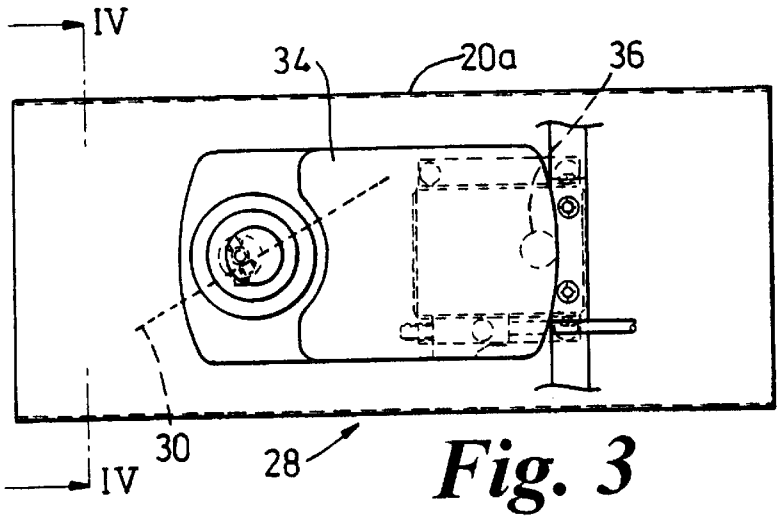
FIG. 3 is a side elevation of said unit.
Figure 4:
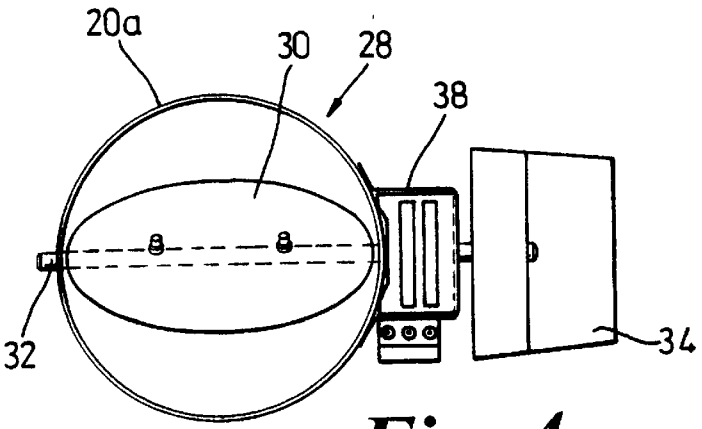
FIG. 4 is a sectional view on line IV—IV of FIG. 3.

To avoid these difficulties using the high thermal input burners 16 the appliance described further includes a control damper and actuator unit 28 situated in tailpipe 20 immediately upstream of fan 22 and now described in detail with reference to FIGS. 2–4.

Unit 28 comprises a short section 20*a* of tailpipe 20 to be coupled into the ducting run on assembly and having a pivoted butterfly control damper 30 carried on a horizontal cross shaft 32. An electric (or other) actuator 34 mounted to one side of section 28 and spaced therefrom to insulate it from excessive heat is selectively operable to turn damper 30 for throttling flow in the tailpipe.

Unit 28 further includes a temperature sensor responsive to the flow temperature in tailpipe section 20*a*, in this example a bimetallic switch 36 mounted on the wall surface of tailpipe section 20*a*. It will be appreciated that various forms of temperature sensor could be used mounted on or within tailpipe 20.

Switch 36 operates through a control module 38 of unit 28 to actuate damper 30, throttling throughflow at lower temperatures. Typically damper 30 will open fully only when the flow temperature in the tailpipe exceeds approximately 50–60° C.

The diameter of ducting 10, including tailpipe 20, is typically 102 mm (4 inches) or 152 mm (6 inches) nominal diameter.

It will be appreciated that an installation may take forms other than that shown, for example there may be more than two branches, or for some applications there night be only a single "branch" or each branch may have one, two or more burner assembles along its length. The branches need not be straight, they could be curved or even of U formation e.g. with one or more burners in each leg. The layout can readily be adapted to suit the shape of the space to be heated and any requirements to concentrate heating in particular areas.

The absence of the long tailpipe is an advantage both in economy of manufacture and installation, in making the installation much more readily adaptable to particular requirements, and in providing tidier and neater appearance.

However, the use of the Control Damper is not limited to installation having a short tailpipe. It is equally effective in providing lower rate start up condition when a Iona tail pipe is chosen, e.g. for installations in very large buildings where it is necessary to position the fan on a side wall a considerable distance from the burners; or where it is preferred to use a long tail pipe to reduce the exit gas temperature and therefore increase the overall thermal efficiency of the system.

As the temperature sensing and consequent flow control is effected in the tailpipe immediately adjacent to the exhaust fan or equivalent the setting and operation of the control damper is unaffected by other features of the installation layout, it is the temperature of the flow acted on by the fan which is being monitored and this is independent of other flow characteristics, e.g. velocity or measured depression, in the tailpipe, or elsewhere in the ducting. Thus the setting up and operation is extremely simple, is easy to check and adjust and requires the minimum of wiring and on-site work to assemble and install.

The substantially equable flow rate past the burners, whether hot or cold, ensures their optimal and safe operation on initial ignition from cold, during warming up, and at running temperatures with high thermal output. Effective start up and combustion reduces noxious emissions and may increase fuel economy.

What is claimed is:

1. A radiant tube heating appliance comprising radiation ducting (10), an exhauster (22) in a tailpipe (20) of the ducting for drawing a flow of gases therethrough in use, and one or more inline fluid fuelled burner assemblies (16), upstream of the tailpipe for generating heat carried by said flow; characterised by a control damper (30) in the tailpipe selectively operable to throttle the flow of gases induced by the exhauster, a power actuator (34) for adjusting the damper, and automatic control means (38) including a temperature sensor (36) responsive to the temperature of gases passing along the tailpipe in use and controlling operation of the actuator so as to reduce the induced flow when said temperature is below a predetermined level as on start-up of the appliance from cold.

2. An appliance as in claim 1 characterised in that the exhauster is a fan (22).

3. An appliance as in claim 2 characterised in that it includes two or more ducting branches (12) acting in parallel and with separate input ends through which individual flows of air are drawn during operation, each branch having a burner assembly or series of burner assemblies (16) spaced along its length and all the branches being connected to a common tailpipe (20) and fan (22) associated with said control means (38).

4. An appliance as in claim 3 wherein the control damper is a pivoted butterfly type damper.

5. An appliance as in claim 2 wherein the control damper is a pivoted butterfly type damper.

6. An appliance as in claim 1, characterised in that it includes a pre-set balancing damper (26) at the downstream end of the ducting (10) upstream of the tailpipe (20).

7. An appliance as in claim 6 wherein the control damper is a pivoted butterfly type damper.

8. An appliance as in claim 1 characterised in that the control damper actuator (34) and automatic control means (38) are constructed as a unit to include a section of the tailpipe (20) with the temperature sensor (36) therein in close proximity to the control damper (30).

9. An appliance as in claim 8 wherein the control damper is a pivoted butterfly type damper.

10. An appliance as in claim 1 wherein the control damper is a pivoted butterfly type damper.

11. An appliance as in claim 1 characterised in that the burner or burners (16) are proportionally controlled high thermal input burners, their heat output increasing in direct proportion to the induced draught in the respective ducting or ducting branch (12) in use, the control damper (30) operating to counteract the increased flow output from the exhauster (22) when handling cold air.

* * * * *